US011473171B1

(12) United States Patent
Liang et al.

(10) Patent No.: US 11,473,171 B1
(45) Date of Patent: Oct. 18, 2022

(54) INTEGRATED METHOD FOR PURIFYING METAL GADOLINIUM AND PREPARING GADOLINIUM OXIDE NANOMATERIALS BY ARC PLASMA

(71) Applicant: KUNMING UNIVERSITY OF SCIENCE AND TECHNOLOGY, Kunming (CN)

(72) Inventors: Feng Liang, Kunming (CN); Zhipeng Xie, Kunming (CN); Zhenggang Tang, Kunming (CN); Da Zhang, Kunming (CN); Bin Yang, Kunming (CN)

(73) Assignee: KUNMING UNIVERSITY OF SCIENCE AND TECHNOLOGY, Kunming (CN)

( * ) Notice: Subject to any disclaimer, the term of this patent is extended or adjusted under 35 U.S.C. 154(b) by 0 days.

(21) Appl. No.: 17/828,063

(22) Filed: May 31, 2022

(51) Int. Cl.

| | |
|---|---|
| ***H05B 7/22*** | (2006.01) |
| ***C22B 59/00*** | (2006.01) |
| ***H05H 1/48*** | (2006.01) |
| ***C22B 9/20*** | (2006.01) |
| ***H05B 7/20*** | (2006.01) |
| ***H05B 7/06*** | (2006.01) |

(52) U.S. Cl.
CPC ..... *C22B 59/00* (2013.01); *C22B 9/20* (2013.01); *H05B 7/06* (2013.01); *H05B 7/20* (2013.01); *H05H 1/48* (2013.01)

(58) Field of Classification Search
CPC .. C22B 59/00; C22B 9/20; H05B 7/06; H05B 7/20; H05H 1/48
USPC ..... 373/42–55, 60–108
See application file for complete search history.

(56) References Cited

FOREIGN PATENT DOCUMENTS

| | | | | |
|---|---|---|---|---|
| CN | 100431748 | C | | 11/2008 |
| CN | 103409650 | A | | 11/2013 |
| CN | 103214042 | B | | 11/2015 |
| CN | 110405221 | A | | 11/2019 |
| CN | 112125287 | A | * | 12/2020 |
| KR | 1143890 | B1 | * | 5/2012 |

* cited by examiner

*Primary Examiner* — Hung D Nguyen

(57) ABSTRACT

The invention discloses a method about the integration of the metallurgical purification of metallic gadolinium and the preparation of gadolinium oxide nanoparticles (GONPs) by arc plasma. The method includes the metallurgical purification and the nanoparticle preparation. Firstly, the gadolinium ingot and a tungsten rod respectively act as an anode and a cathode. After the arc furnace is evacuated and then is filled with a working atmosphere, impurities in the gadolinium ingot are removed in the form of volatilization to obtain purified gadolinium by the first arc discharge. Whereafter, the purified gadolinium and the tungsten rod are used as the anode and cathode. After the arc furnace also is evacuated and then also is filled with a working atmosphere, GONPs are obtained from the inner wall of the arc furnace though the second arc discharge. The metallurgical purification of metallic gadolinium and the preparation of GONPs were integrated by arc plasma.

7 Claims, 6 Drawing Sheets

(1) Using the arc plasma method to purify metal gadolinium: a gadolinium ingot and a tungsten rod act as an anode and a cathode of arc plasma. After the arc furnace is evacuated and then is filled by a working atmosphere, the impurities in the gadolinium ingot are removed in the form of volatilization to obtain a high-purity gadolinium by the first arc discharge.

↓

(2) Preparing GONPs from gadolinium obtained after purification in step (1) by arc plasma method: the high-purity gadolinium and the tungsten rod are used as the anode and cathode, respectively. After the arc furnace also is evacuated and then also is filled by a working atmosphere, GONPs are obtained from the inner wall of the arc furnace though the second arc discharge.

INTEGRATED METHOD FOR PURIFYING METAL GADOLINIUM AND PREPARING GADOLINIUM OXIDE NANOMATERIALS BY ARC PLASMA

TECHNICAL FIELD

The invention relates to preparation of high-purity rare earth metal nanomaterials, particularly a method for integration of metallurgical purification of metallic gadolinium and preparation of GONPs by arc plasma.

BACKGROUND

Rare earth is a valuable strategic resource and is widely used in cutting-edge technology and military industries. Rare earth elements were originally found in minerals in Sweden, and materials containing rare earth elements are called rare earth materials. Rare earth elements include a total of 17 kinds, namely lanthanides—lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), lutetium (Lu), scandium (Sc), and yttrium (Y). Rare earth elements have a specific 4f layer electronic configuration. The 4f layer electrons are shielded by filled outer 5s and 5p electrons, resulting in different movement modes of 4f layer electrons, which endows rare earth elements the special physical and chemical properties, such as optics, electricity, and magnetism. Among them, metal Gd is a rare earth element that involves the most fields among all new rare earth materials and plays an important role in the field of new functional materials. It is found the high-purity metals have a large magnetocaloric effect at near room temperature, which is the most common magnetic refrigeration material at room temperature. Therefore, gadolinium-based phosphors are widely used in imaging, light sources, X-ray intensifying screens, and radiology imaging in medical. The research on gadolinium-based nuclear reaction structural materials, nuclear reactor control materials, and nuclear reactor shielding materials has become a great focus. GONPs are widely used in diagnosis and therapy, magnetic resonance imaging, and other fields. With the continuous emergence of new materials, the application of rare earth gadolinium in different fields will become more and more extensive, and the demand for the purity will also increase.

Purification methods of metals mainly include vacuum distillation, vacuum melting, electron beam melting, electromigration, zone melting, and electrolytic refining. Thereinto, the vacuum distillation has relatively large limitations and is only used to purify metals with high vapor pressure near the melting point. The electrolytic refining has a long process flow, and the risk of metal contamination during purification process is high. The faced problems of above purification methods are as follows: 1: Long-operation time and low efficiency; 2: Gas impurities O and N are difficult to remove; 3: High requirements for raw materials and insufficient product purity; 4: Poor operating environment, which is easy to cause secondary pollution.

The inventor finds that an arc plasma is a very promising technology which is used to refine and purify metal gadolinium. It has the advantages of high impurity removal, high efficiency, and environmental friendliness. It can be used in metallurgical refining fields such as metal refining, remelting refining, and industrial silicon purification. The inventor also finds that the arc plasma has many advantages for metal refining and purification. Meanwhile, this method can also be used to prepare nanomaterials. The main advantages of preparing nanomaterials are high-purity products, uniform distribution of particle size, good-product dispersion, controlled-preparation process, and environmental friendliness. Therefore, the inventor believes that it is necessary to combine advantages of metallurgical purification and nanoparticle preparation by arc plasma. Therefore, the arc plasma is used to realize integration of metallic gadolinium purification and GONPs preparation.

SUMMARY OF THE INVENTION

The embodiment of the present disclosure provides an integrated method to purify metallic gadolinium and prepare GONPs by arc plasma, which can effectively remove most of impurities in metallic gadolinium. The embodiment of the present disclosure further provides a gadolinium oxide nanomaterial with high purity, small particle size, and good dispersibility prepared by the method. The integration of metallurgical purification of metallic gadolinium and preparation of GONPs by arc plasma is realized.

DETAILED DESCRIPTION

The present disclosure will be further described in detail below concerning the accompanying drawings and specific embodiments, but the protection scope of the present disclosure is not limited to the content.

Example 1

Figure 9:
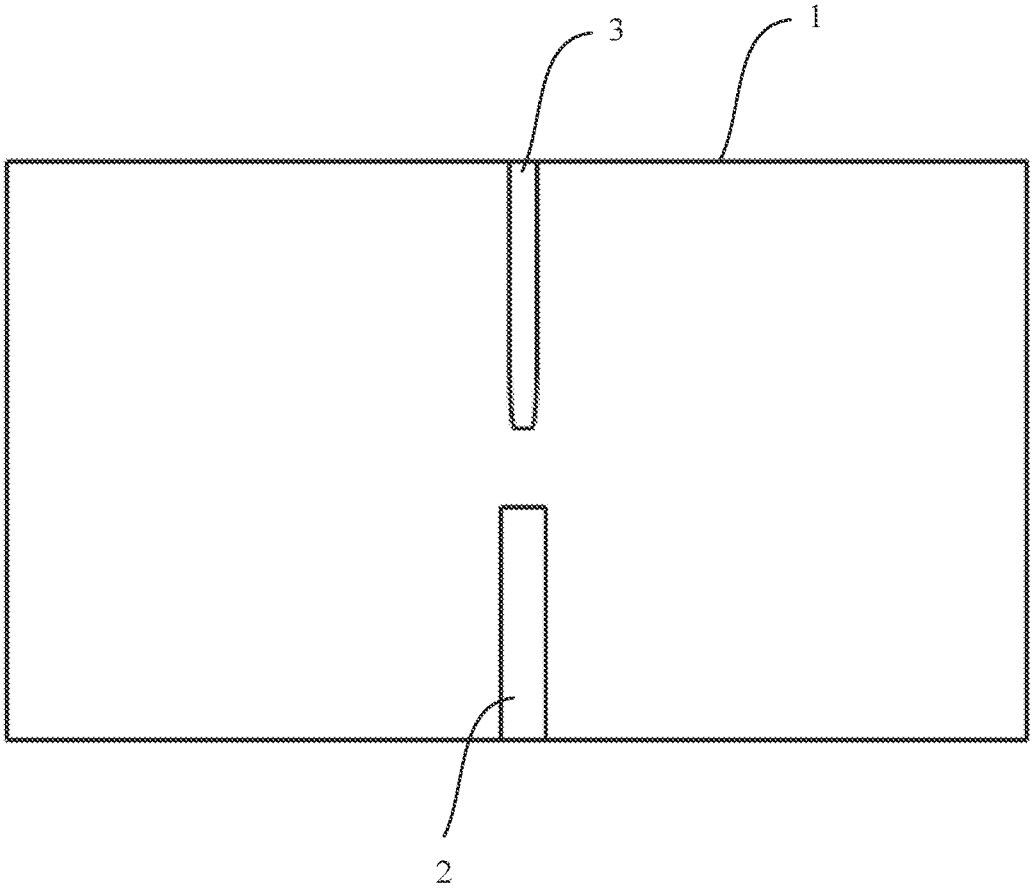
FIG. 9 is a schematic view of an arc furnace according to an embodiment of the present disclosure.

An integrated method for purifying metal gadolinium and preparing GONPs by arc plasma, the specific process is as follows:

In the step (1), metallurgical purification of metallic gadolinium by arc plasma: a gadolinium ingot 2 (the mass is about 20 g) and a tungsten rod 3 are placed in an arc furnace 1 and act as an anode and a cathode of arc plasma respectively (referring to FIG. 9). In at least one embodiment, the cathode and the anode are placed vertically in the arc furnace (for example, along a direction perpendicular to the horizontal direction) at a distance of 8 mm. After the arc furnace is evacuated and then is filled with 50 kPa argon (Ar), the arc furnace is powered on to perform a first arc discharge, the discharge current and discharge time are set to be 100 A and 40 min, respectively. Impurities in the gadolinium ingot are removed in a form of volatilization to obtain purified gadolinium by the first arc discharge. After that, the purity of gadolinium ingot was tested by the inductively coupled plasma mass spectrometer (ICP-MS).

In the step (2), preparation of GONPs by arc plasma: the purified gadolinium obtained in the step (1) and the tungsten rod are placed in the arc furnace and used as a second anode and a second cathode, respectively. The second cathode and the second anode can be vertically located in the arc furnace (for example, located in the arc furnace in a vertical direction perpendicular to the horizontal direction) at a distance of 5 mm. After the arc furnace is evacuated, it is filled with 70 kPa air. The arc furnace is powered on to perform a second arc discharge. The discharge current and discharge time are 200 A and 15 min, respectively. GONPs are obtained from an inner wall of the arc furnace after the second arc discharge.

Example 2

An integrated method for purifying metal gadolinium and preparing GONPs by arc plasma, the specific process is as follows:

In the step (1), metallurgical purification of metallic gadolinium by arc plasma: a gadolinium ingot (the mass is about 20 g) and a tungsten rod are placed in an arc furnace and act as an anode and a cathode of arc plasma respectively. In at least one embodiment, the cathode and the anode are placed vertically in the arc furnace (for example, along a direction perpendicular to the horizontal direction) at a distance of 8 mm. After the arc furnace is evacuated and then is filled with 50 kPa argon (Ar), the arc furnace is powered on to perform a first arc discharge, the discharge current and discharge time are set to be 100 A and 40 min, respectively. Impurities in the gadolinium ingot are removed in a form of volatilization to obtain purified gadolinium by the first arc discharge. After that, the purity of gadolinium ingot was tested by the inductively coupled plasma mass spectrometer (ICP-MS).

In the step (2), preparation of GONPs by arc plasma: the purified gadolinium obtained in the step (1) and the tungsten rod are placed in the arc furnace and used as a second anode and a second cathode, respectively. The second cathode and the second anode can be vertically located in the arc furnace (for example, located in the arc furnace in a vertical direction perpendicular to the horizontal direction) at a distance of 5 mm. After the arc furnace is evacuated, it is filled with 70 kPa air. The arc furnace is powered on to perform a second arc discharge. The discharge current and discharge time are 200 A and 15 min, respectively. GONPs are obtained from an inner wall of the arc furnace after the second arc discharge.

Example 3

An integrated method for purifying metal gadolinium and preparing GONPs by arc plasma, the specific process is as follows:

In the step (1), metallurgical purification of metallic gadolinium by arc plasma: a gadolinium ingot (the mass is about 20 g) and a tungsten rod are placed in an arc furnace and act as an anode and a cathode of arc plasma respectively. In at least one embodiment, the cathode and the anode are placed vertically in the arc furnace (for example, along a direction perpendicular to the horizontal direction) at a distance of 8 mm. After the arc furnace is evacuated and then is filled with 50 kPa argon (Ar), the arc furnace is powered on to perform a first arc discharge, the discharge current and discharge time are set to be 150 A and 40 min, respectively. Impurities in the gadolinium ingot are removed in a form of volatilization to obtain purified gadolinium by the first arc discharge. After that, the purity of gadolinium ingot was tested by the inductively coupled plasma mass spectrometer (ICP-MS).

In the step (2), preparation of GONPs by arc plasma: the purified gadolinium obtained in the step (1) and the tungsten rod are placed in the arc furnace and used as a second anode and a second cathode, respectively. The second cathode and the second anode can be vertically located in the arc furnace (for example, located in the arc furnace in a vertical direction perpendicular to the horizontal direction) at a distance of 5 mm. After the arc furnace is evacuated, it is filled with 70 kPa air. The arc furnace is powered on to perform a second arc discharge. The discharge current and discharge time are 200 A and 15 min, respectively. GONPs are obtained from an inner wall of the arc furnace after the second arc discharge.

Example 4

An integrated method for purifying metal gadolinium and preparing GONPs by arc plasma, the specific process is as follows:

In the step (1), metallurgical purification of metallic gadolinium by arc plasma: a gadolinium ingot (the mass is about 20 g) and a tungsten rod are placed in an arc furnace and act as an anode and a cathode of arc plasma respectively. In at least one embodiment, the cathode and the anode are placed vertically in the arc furnace (for example, along a direction perpendicular to the horizontal direction) at a distance of 8 mm. After the arc furnace is evacuated and then is filled with 50 kPa argon (Ar), the arc furnace is powered on to perform a first arc discharge, the discharge current and discharge time are set to be 175 A and 40 min, respectively. Impurities in the gadolinium ingot are removed in a form of volatilization to obtain purified gadolinium by the first arc discharge. After that, the purity of gadolinium ingot was tested by the inductively coupled plasma mass spectrometer (ICP-MS).

In the step (2), preparation of GONPs by arc plasma: the purified gadolinium obtained in the step (1) and the tungsten rod are placed in the arc furnace and used as a second anode and a second cathode, respectively. The second cathode and the second anode can be vertically located in the arc furnace (for example, located in the arc furnace in a vertical direction perpendicular to the horizontal direction) at a distance of 5 mm. After the arc furnace is evacuated, it is filled with 70 kPa air. The arc furnace is powered on to perform a second arc discharge. The discharge current and discharge time are 200 A and 15 min, respectively. GONPs are obtained from an inner wall of the arc furnace after the second arc discharge.

Example 5

An integrated method for purifying metal gadolinium and preparing GONPs by arc plasma, the specific process is as follows:

In the step (1), metallurgical purification of metallic gadolinium by arc plasma: a gadolinium ingot (the mass is about 20 g) and a tungsten rod are placed in an arc furnace and act as an anode and a cathode of arc plasma respectively. In at least one embodiment, the cathode and the anode are placed vertically in the arc furnace (for example, along a direction perpendicular to the horizontal direction) at a distance of 8 mm. After the arc furnace is evacuated and then is filled with 50 kPa argon (Ar), the arc furnace is powered on to perform a first arc discharge, the discharge current and discharge time are set to be 200 A and 40 min, respectively. Impurities in the gadolinium ingot are removed in a form of volatilization to obtain purified gadolinium by the first arc discharge. After that, the purity of gadolinium ingot was tested by the inductively coupled plasma mass spectrometer (ICP-MS).

In the step (2), preparation of GONPs by arc plasma: the purified gadolinium obtained in the step (1) and the tungsten rod are placed in the arc furnace and used as a second anode and a second cathode, respectively. The second cathode and the second anode can be vertically located in the arc furnace (for example, located in the arc furnace in a vertical direction perpendicular to the horizontal direction) at a distance of 5 mm. After the arc furnace is evacuated, it is filled with 70 kPa air. The arc furnace is powered on to perform a second arc discharge. The discharge current and discharge time are 200 A and 15 min, respectively. GONPs are obtained from an inner wall of the arc furnace after the second arc discharge.

Figure 1:
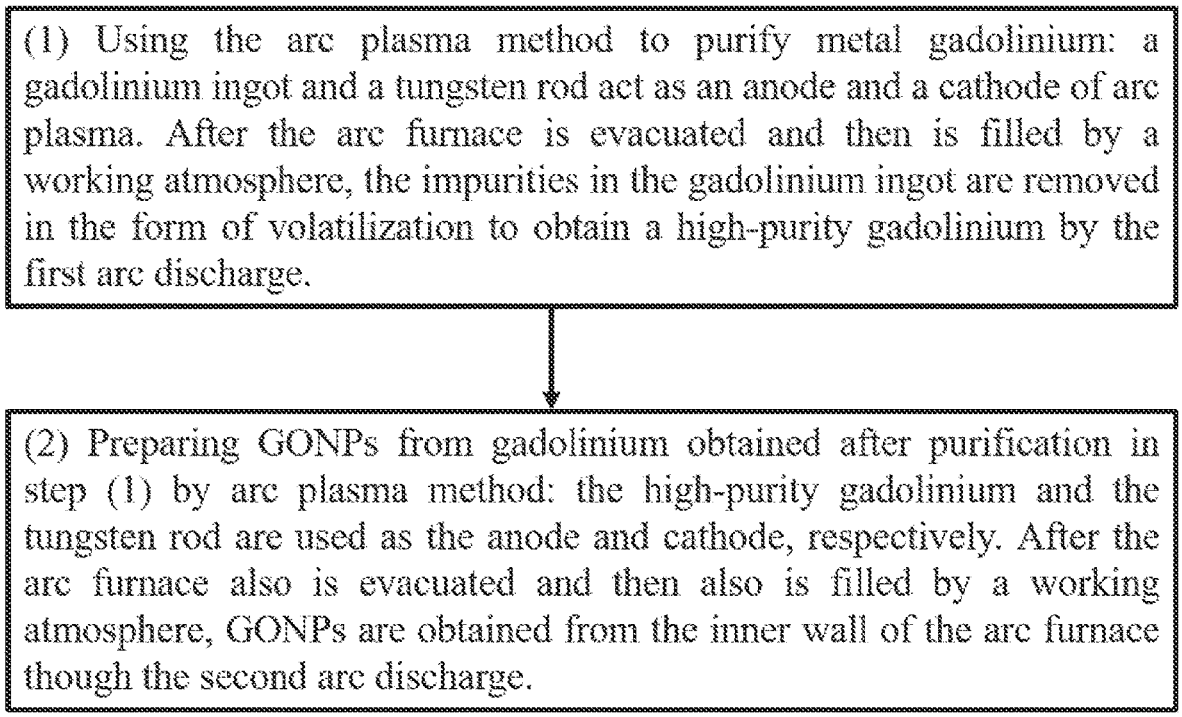
FIG. 1 is a flow chart of integration of purifying metallic gadolinium and preparing GONPs by arc plasma according to an embodiment of the present disclosure.
Figure 2:
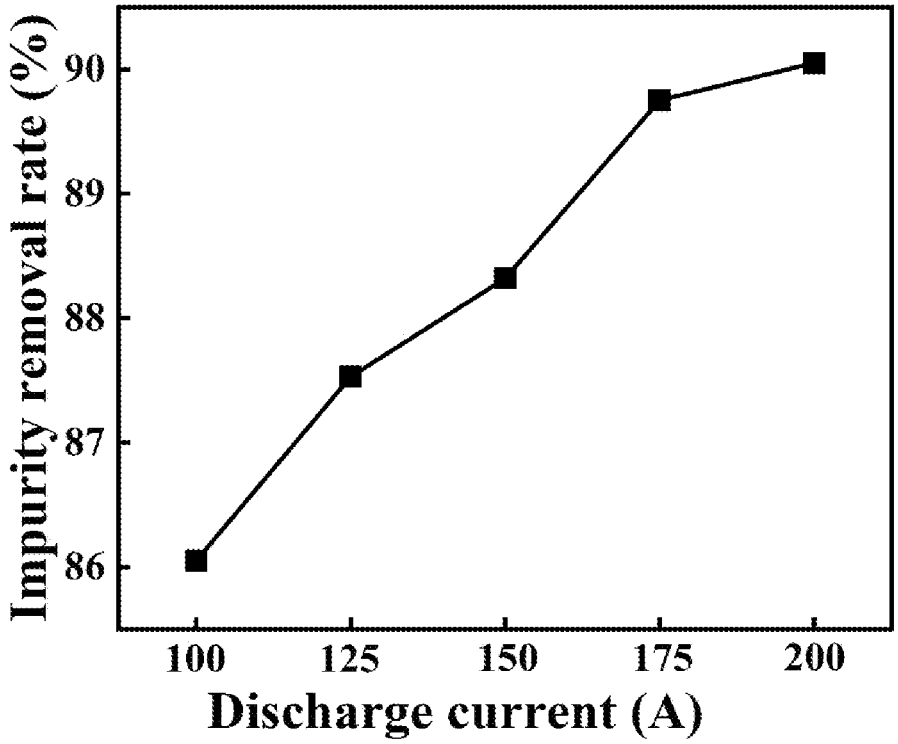
FIG. 2 is a schematic diagram illustrating discharge current in Examples 1, 2, 3, 4, and 5 on purification of metallic gadolinium.

Further, the inductively coupled plasma mass spectrometer (ICP-MS) result of Examples 1, 2, 3, 4, and 5 are as shown in FIG. 2. It can be seen from FIG. 2 that with the increase of the discharge current, the impurity removal rate increases continuously. Therefore, the greater the discharge current, the better the purification effect.

Example 6

An integrated method for purifying metal gadolinium and preparing GONPs by arc plasma, the specific process is as follows:

In the step (1), metallurgical purification of metallic gadolinium by arc plasma: a gadolinium ingot (the mass is about 20 g) and a tungsten rod are placed in an arc furnace and act as an anode and a cathode of arc plasma respectively. In at least one embodiment, the cathode and the anode are placed vertically in the arc furnace (for example, along a direction perpendicular to the horizontal direction) at a distance of 8 mm. After the arc furnace is evacuated and then is filled with 50 kPa argon (Ar), the arc furnace is powered on to perform a first arc discharge, the discharge current and discharge time are set to be 200 A and 25 min, respectively. Impurities in the gadolinium ingot are removed in a form of volatilization to obtain purified gadolinium by the first arc discharge. After that, the purity of gadolinium ingot was tested by the inductively coupled plasma mass spectrometer (ICP-MS).

In the step (2), preparation of GONPs by arc plasma: the purified gadolinium obtained in the step (1) and the tungsten rod are placed in the arc furnace and used as a second anode and a second cathode, respectively. The second cathode and the second anode can be vertically located in the arc furnace (for example, located in the arc furnace in a vertical direction perpendicular to the horizontal direction) at a distance of 5 mm. After the arc furnace is evacuated, it is filled with 70 kPa air. The arc furnace is powered on to perform a second arc discharge. The discharge current and discharge time are 200 A and 15 min, respectively. GONPs are obtained from an inner wall of the arc furnace after the second arc discharge.

Example 7

An integrated method for purifying metal gadolinium and preparing GONPs by arc plasma, the specific process is as follows:

In the step (1), metallurgical purification of metallic gadolinium by arc plasma: a gadolinium ingot (the mass is about 20 g) and a tungsten rod are placed in an arc furnace and act as an anode and a cathode of arc plasma respectively. In at least one embodiment, the cathode and the anode are placed vertically in the arc furnace (for example, along a direction perpendicular to the horizontal direction) at a distance of 8 mm. After the arc furnace is evacuated and then is filled with 50 kPa argon (Ar), the arc furnace is powered on to perform a first arc discharge, the discharge current and discharge time are set to be 200 A and 30 min, respectively. Impurities in the gadolinium ingot are removed in a form of volatilization to obtain purified gadolinium by the first arc discharge. After that, the purity of gadolinium ingot was tested by the inductively coupled plasma mass spectrometer (ICP-MS).

In the step (2), preparation of GONPs by arc plasma: the purified gadolinium obtained in the step (1) and the tungsten rod are placed in the arc furnace and used as a second anode and a second cathode, respectively. The second cathode and the second anode can be vertically located in the arc furnace (for example, located in the arc furnace in a vertical direction perpendicular to the horizontal direction) at a distance of 5 mm. After the arc furnace is evacuated, it is filled with 70 kPa air. The arc furnace is powered on to perform a second arc discharge. The discharge current and discharge time are 200 A and 15 min, respectively. GONPs are obtained from an inner wall of the arc furnace after the second arc discharge.

Example 8

An integrated method for purifying metal gadolinium and preparing GONPs by arc plasma, the specific process is as follows:

In the step (1), metallurgical purification of metallic gadolinium by arc plasma: a gadolinium ingot (the mass is about 20 g) and a tungsten rod are placed in an arc furnace and act as an anode and a cathode of arc plasma respectively. In at least one embodiment, the cathode and the anode are placed vertically in the arc furnace (for example, along a direction perpendicular to the horizontal direction) at a distance of 8 mm. After the arc furnace is evacuated and then is filled with 50 kPa argon (Ar), the arc furnace is powered on to perform a first arc discharge, the discharge current and discharge time are set to be 200 A and 35 min, respectively. Impurities in the gadolinium ingot are removed in a form of volatilization to obtain purified gadolinium by the first arc discharge. After that, the purity of gadolinium ingot was tested by the inductively coupled plasma mass spectrometer (ICP-MS).

In the step (2), preparation of GONPs by arc plasma: the purified gadolinium obtained in the step (1) and the tungsten rod are placed in the arc furnace and used as a second anode and a second cathode, respectively. The second cathode and the second anode can be vertically located in the arc furnace (for example, located in the arc furnace in a vertical direction perpendicular to the horizontal direction) at a distance of 5 mm. After the arc furnace is evacuated, it is filled with 70 kPa air. The arc furnace is powered on to perform a second arc discharge. The discharge current and discharge time are 200 A and 15 min, respectively. GONPs are obtained from an inner wall of the arc furnace after the second arc discharge.

Example 9

An integrated method for purifying metal gadolinium and preparing GONPs by arc plasma, the specific process is as follows:

In the step (1), metallurgical purification of metallic gadolinium by arc plasma: a gadolinium ingot (the mass is about 20 g) and a tungsten rod are placed in an arc furnace and act as an anode and a cathode of arc plasma respectively. In at least one embodiment, the cathode and the anode are placed vertically in the arc furnace (for example, along a direction perpendicular to the horizontal direction) at a distance of 8 mm. After the arc furnace is evacuated and then is filled with 50 kPa argon (Ar), the arc furnace is powered on to perform a first arc discharge, the discharge current and discharge time are set to be 200 A and 40 min, respectively. Impurities in the gadolinium ingot are removed in a form of volatilization to obtain purified gadolinium by the first arc discharge. After that, the purity of gadolinium ingot was tested by the inductively coupled plasma mass spectrometer (ICP-MS).

In the step (2), preparation of GONPs by arc plasma: the purified gadolinium obtained in the step (1) and the tungsten rod are placed in the arc furnace and used as a second anode and a second cathode, respectively. The second cathode and the second anode can be vertically located in the arc furnace (for example, located in the arc furnace in a vertical direction perpendicular to the horizontal direction) at a distance of 5 mm. After the arc furnace is evacuated, it is filled with 70 kPa air. The arc furnace is powered on to perform a second arc discharge. The discharge current and discharge time are 200 A and 15 min, respectively. GONPs are obtained from an inner wall of the arc furnace after the second arc discharge.

Figure 3:
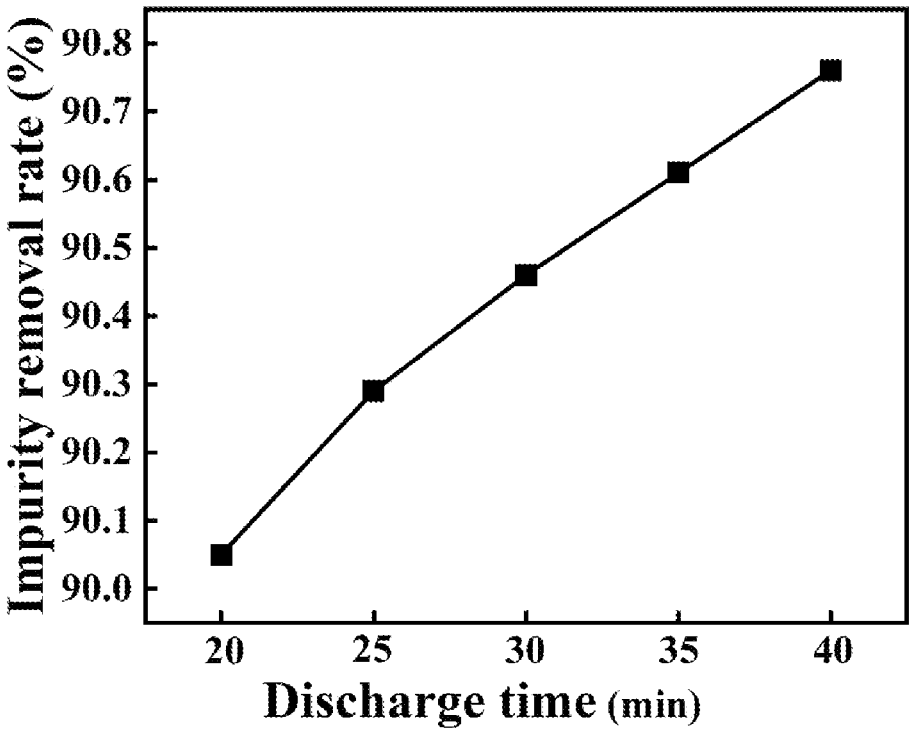
FIG. 3 is a schematic diagram illustrating discharge time in Examples 5, 6, 7, 8, and 9 on purification of metallic gadolinium.

Further, the inductively coupled plasma mass spectrometer (ICP-MS) result of Examples 5, 6, 7, 8, and 9 are as shown in FIG. 3. It can be seen from FIG. 3 that with the extension of the discharge time, the impurity removal rate increases continuously. Therefore, the greater the discharge time, the better the purification effect.

Example 10

An integrated method for purifying metal gadolinium and preparing GONPs by arc plasma, the specific process is as follows:

In the step (1), metallurgical purification of metallic gadolinium by arc plasma: a gadolinium ingot (the mass is about 20 g) and a tungsten rod are placed in an arc furnace and act as an anode and a cathode of arc plasma respectively. In at least one embodiment, the cathode and the anode are placed vertically in the arc furnace (for example, along a direction perpendicular to the horizontal direction) at a distance of 8 mm. After the arc furnace is evacuated and then is filled with 30 kPa argon (Ar), the arc furnace is powered on to perform a first arc discharge, the discharge current and discharge time are set to be 200 A and 40 min, respectively. Impurities in the gadolinium ingot are removed in a form of volatilization to obtain purified gadolinium by the first arc discharge. After that, the purity of gadolinium ingot was tested by the inductively coupled plasma mass spectrometer (ICP-MS).

In the step (2), preparation of GONPs by arc plasma: the purified gadolinium obtained in the step (1) and the tungsten rod are placed in the arc furnace and used as a second anode and a second cathode, respectively. The second cathode and the second anode can be vertically located in the arc furnace (for example, located in the arc furnace in a vertical direction perpendicular to the horizontal direction) at a distance of 5 mm. After the arc furnace is evacuated, it is filled with 70 kPa air. The arc furnace is powered on to perform a second arc discharge. The discharge current and discharge time are 200 A and 15 min, respectively. GONPs are obtained from an inner wall of the arc furnace after the second arc discharge.

Example 11

An integrated method for purifying metal gadolinium and preparing GONPs by arc plasma, the specific process is as follows:

In the step (1), metallurgical purification of metallic gadolinium by arc plasma: a gadolinium ingot (the mass is about 20 g) and a tungsten rod are placed in an arc furnace and act as an anode and a cathode of arc plasma respectively. In at least one embodiment, the cathode and the anode are placed vertically in the arc furnace (for example, along a direction perpendicular to the horizontal direction) at a distance of 8 mm. After the arc furnace is evacuated and then is filled with 40 kPa argon (Ar), the arc furnace is powered on to perform a first arc discharge, the discharge current and discharge time are set to be 200 A and 40 min, respectively. Impurities in the gadolinium ingot are removed in a form of volatilization to obtain purified gadolinium by the first arc discharge. After that, the purity of gadolinium ingot was tested by the inductively coupled plasma mass spectrometer (ICP-MS).

In the step (2), preparation of GONPs by arc plasma: the purified gadolinium obtained in the step (1) and the tungsten rod are placed in the arc furnace and used as a second anode and a second cathode, respectively. The second cathode and the second anode can be vertically located in the arc furnace (for example, located in the arc furnace in a vertical direction perpendicular to the horizontal direction) at a distance of 5 mm. After the arc furnace is evacuated, it is filled with 70 kPa air. The arc furnace is powered on to perform a second arc discharge. The discharge current and discharge time are 200 A and 15 min, respectively. GONPs are obtained from an inner wall of the arc furnace after the second arc discharge.

Example 12

An integrated method for purifying metal gadolinium and preparing GONPs by arc plasma, the specific process is as follows:

In the step (1), metallurgical purification of metallic gadolinium by arc plasma: a gadolinium ingot (the mass is about 20 g) and a tungsten rod are placed in an arc furnace and act as an anode and a cathode of arc plasma respectively. In at least one embodiment, the cathode and the anode are placed vertically in the arc furnace (for example, along a direction perpendicular to the horizontal direction) at a distance of 8 mm. After the arc furnace is evacuated and then is filled with 60 kPa argon (Ar), the arc furnace is powered on to perform a first arc discharge, the discharge current and discharge time are set to be 200 A and 40 min, respectively. Impurities in the gadolinium ingot are removed in a form of volatilization to obtain purified gadolinium by the first arc discharge. After that, the purity of gadolinium ingot was tested by the inductively coupled plasma mass spectrometer (ICP-MS).

In the step (2), preparation of GONPs by arc plasma: the purified gadolinium obtained in the step (1) and the tungsten rod are placed in the arc furnace and used as a second anode and a second cathode, respectively. The second cathode and the second anode can be vertically located in the arc furnace (for example, located in the arc furnace in a vertical direction perpendicular to the horizontal direction) at a distance of 5 mm. After the arc furnace is evacuated, it is filled with 70 kPa air. The arc furnace is powered on to perform a second arc discharge. The discharge current and discharge time are 200 A and 15 min, respectively. GONPs are obtained from an inner wall of the arc furnace after the second arc discharge.

Example 13

An integrated method for purifying metal gadolinium and preparing GONPs by arc plasma, the specific process is as follows:

In the step (1), metallurgical purification of metallic gadolinium by arc plasma: a gadolinium ingot (the mass is about 20 g) and a tungsten rod are placed in an arc furnace and act as an anode and a cathode of arc plasma respectively. In at least one embodiment, the cathode and the anode are placed vertically in the arc furnace (for example, along a direction perpendicular to the horizontal direction) at a distance of 8 mm. After the arc furnace is evacuated and then is filled with 70 kPa argon (Ar), the arc furnace is powered on to perform a first arc discharge, the discharge current and discharge time are set to be 200 A and 40 min, respectively. Impurities in the gadolinium ingot are removed in a form of volatilization to obtain purified gadolinium by the first arc discharge. After that, the purity of gadolinium ingot was tested by the inductively coupled plasma mass spectrometer (ICP-MS).

In the step (2), preparation of GONPs by arc plasma: the purified gadolinium obtained in the step (1) and the tungsten rod are placed in the arc furnace and used as a second anode and a second cathode, respectively. The second cathode and the second anode can be vertically located in the arc furnace (for example, located in the arc furnace in a vertical direction perpendicular to the horizontal direction) at a distance of 5 mm. After the arc furnace is evacuated, it is filled with 70 kPa air. The arc furnace is powered on to perform a second arc discharge. The discharge current and discharge time are 200 A and 15 min, respectively. GONPs are obtained from an inner wall of the arc furnace after the second arc discharge.

Figure 4:
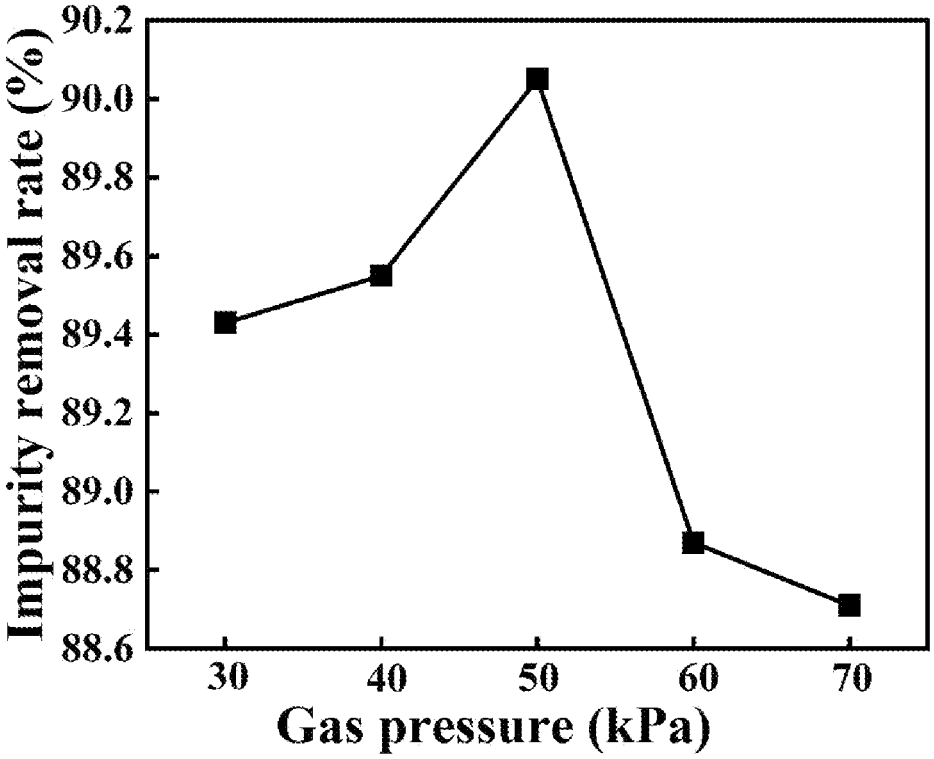
FIG. 4 is a schematic diagram illustrating gas pressure in Examples 1, 14, and 15 on purification of metallic gadolinium.

Further, the inductively coupled plasma mass spectrometer (ICP-MS) result of Examples 5, 10, 11, 12, and 13 are as shown in FIG. 4. It can be seen from FIG. 4 that the impurity removal rate first increases and then decreases with the increase of gas pressure, and the impurity removal effect is the best when the gas pressure is 50 kPa.

Example 14

An integrated method for purifying metal gadolinium and preparing GONPs by arc plasma, the specific process is as follows:

In the step (1), metallurgical purification of metallic gadolinium by arc plasma: a gadolinium ingot (the mass is about 20 g) and a tungsten rod are placed in an arc furnace and act as an anode and a cathode of arc plasma respectively. In at least one embodiment, the cathode and the anode are placed vertically in the arc furnace (for example, along a direction perpendicular to the horizontal direction) at a distance of 8 mm. After the arc furnace is evacuated and then is filled with 50 kPa argon (Ar)+5% hydrogen ($H_2$), the arc furnace is powered on to perform a first arc discharge, the discharge current and discharge time are set to be 200 A and 40 min, respectively. Impurities in the gadolinium ingot are removed in a form of volatilization to obtain purified gadolinium by the first arc discharge. After that, the purity of gadolinium ingot was tested by the inductively coupled plasma mass spectrometer (ICP-MS).

In the step (2), preparation of GONPs by arc plasma: the purified gadolinium obtained in the step (1) and the tungsten rod are placed in the arc furnace and used as a second anode and a second cathode, respectively. The second cathode and the second anode can be vertically located in the arc furnace (for example, located in the arc furnace in a vertical direction perpendicular to the horizontal direction) at a distance of 5 mm. After the arc furnace is evacuated, it is filled with 70 kPa air. The arc furnace is powered on to perform a second arc discharge. The discharge current and discharge time are 200 A and 15 min, respectively. GONPs are obtained from an inner wall of the arc furnace after the second arc discharge.

Example 15

An integrated method for purifying metal gadolinium and preparing GONPs by arc plasma, the specific process is as follows:

In the step (1), metallurgical purification of metallic gadolinium by arc plasma: a gadolinium ingot (the mass is about 20 g) and a tungsten rod are placed in an arc furnace and act as an anode and a cathode of arc plasma respectively. In at least one embodiment, the cathode and the anode are placed vertically in the arc furnace (for example, along a direction perpendicular to the horizontal direction) at a distance of 8 mm. After the arc furnace is evacuated and then is filled with 50 kPa argon (Ar)+5% hydrogen ($H_2$), the arc furnace is powered on to perform a first arc discharge, the discharge current and discharge time are set to be 200 A and 40 min, respectively. Impurities in the gadolinium ingot are removed in a form of volatilization to obtain purified gadolinium by the first arc discharge. After that, the purity of gadolinium ingot was tested by the inductively coupled plasma mass spectrometer (ICP-MS).

In the step (2), preparation of GONPs by arc plasma: the purified gadolinium obtained in the step (1) and the tungsten rod are placed in the arc furnace and used as a second anode and a second cathode, respectively. The second cathode and the second anode can be vertically located in the arc furnace (for example, located in the arc furnace in a vertical direction perpendicular to the horizontal direction) at a distance of 5 mm. After the arc furnace is evacuated, it is filled with 70 kPa air. The arc furnace is powered on to perform a second arc discharge. The discharge current and discharge time are 200 A and 15 min, respectively. GONPs are obtained from an inner wall of the arc furnace after the second arc discharge, and the GONPs were analyzed by X-ray diffractometer (XRD) and transmission electron microscope (TEM).

Figure 5:
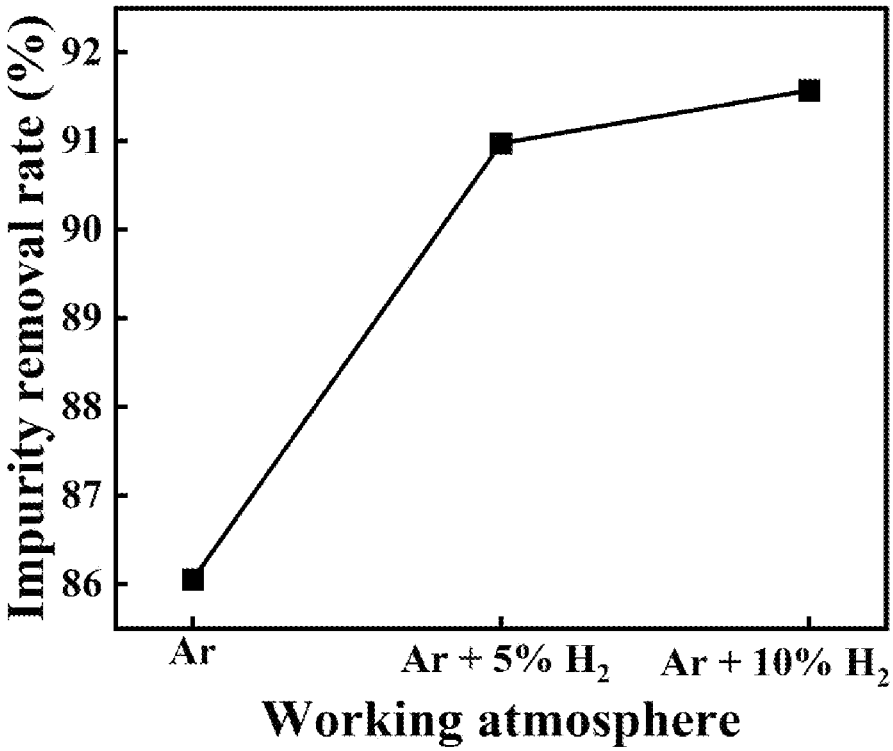
FIG. 5 is a schematic diagram illustrating plasma atmosphere in Examples 5, 10, 11, 12, and 13 on purification of metallic gadolinium.

Further, the inductively coupled plasma mass spectrometer (ICP-MS) result of Examples 1, 14, and 15 are as shown in FIG. 5. It can be seen from FIG. 5 that addition of hydrogen ($H_2$) can greatly improve an impurity removal rate. When a volume ratio of argon (Ar) and hydrogen ($H_2$) is 90:10, the impurity removal effect exhibits best. In the purification process, the impurity content in metallic gadolinium was determined by the inductively coupled plasma mass spectrometer (ICP-MS), the impurity removal rate was used to represent the impurity removal effect, and the calculation formula of impurity removal rate is: impurity removal rate $$(\%) = \left[\frac{(C_i - C_f)}{C_i} \times 100\%\right],$$

where $C_i$ and $C_f$ represent the initial and final contents of the impurity elements, respectively. The formula for calculating purity is:

$$\text{Purity}(\%) = \left(1 - \frac{C}{1 \times 10^6}\right) \times 100\%,$$

where C is the total content of impurities.

Figure 6:
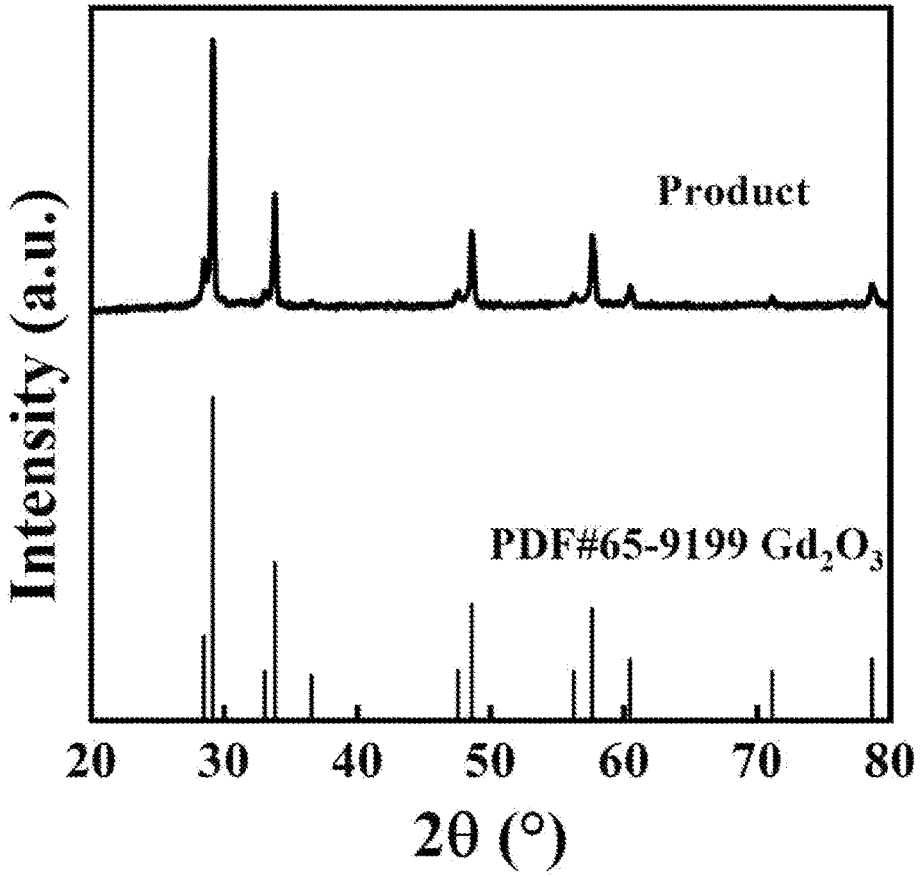
FIG. 6 is a schematic diagram illustrating X-ray diffractometer (XRD) pattern of a gadolinium oxide nanomaterial prepared in Example 15.
Figure 7:
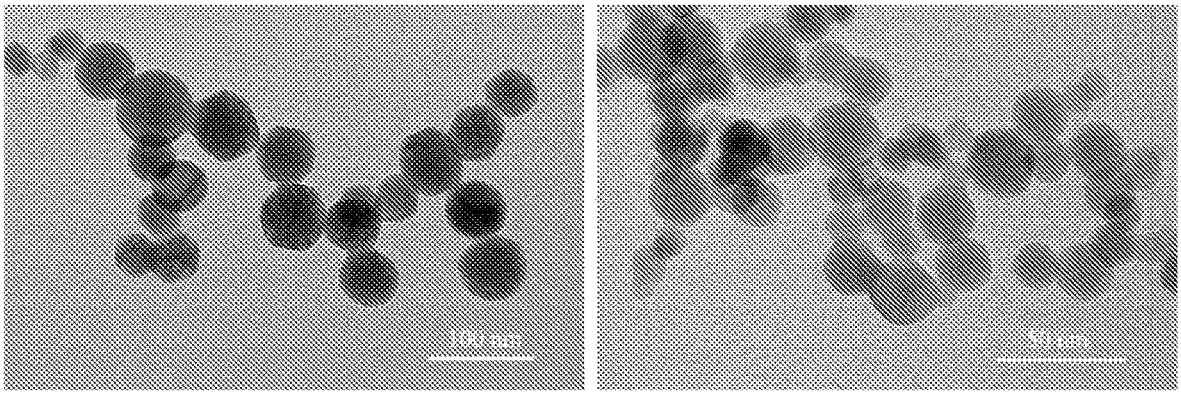
FIG. 7 is a transmission electron microscope (TEM) image of the gadolinium oxide nanomaterial prepared in Example 15.
Figure 8:
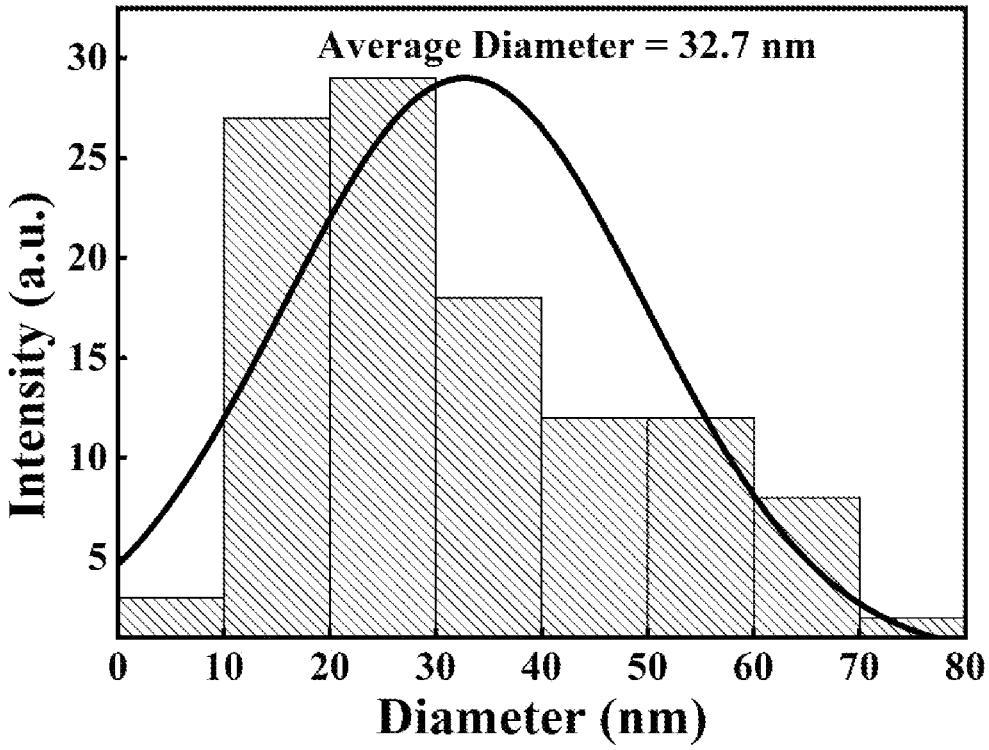
FIG. 8 is a size distribution diagram of the gadolinium oxide nanomaterial prepared in Example 15.

FIG. 6 is a schematic diagram illustrating X-ray diffractometer (XRD) pattern of a gadolinium oxide nanomaterial prepared in Example 15, in the 20 range from 20° to 80°, the diffraction peak position of the synthesized nanoparticles was consistent with the diffraction peak position of the $Gd_2O_3$ standard card (PDF #65-9199), and no other impurity peaks were observed. This indicates that the prepared GONPs are very pure. FIG. 7 is a transmission electron microscope (TEM) image of the gadolinium oxide nanomaterial prepared in Example 15, it can be observed from the transmission electron microscope (TEM) images that the GONPs have a regular spherical structure, a smooth particle surface, and appropriate dispersibility. FIG. 8 is a size distribution diagram of the gadolinium oxide nanomaterial prepared in Example 15, the sizes of the GONPs are in the range of 9-80 nm, and the average particle size is 32.7 nm.

What is claimed as follows:

1. A method for integration of metallurgical purification of metallic gadolinium and preparation of Gadolinium Oxide Nanoparticles (GONPs) by arc plasma, comprising:

(1). metallurgical purification of metallic gadolinium by arc plasma: a gadolinium ingot and a tungsten rod are arranged in an arc furnace and act as a first anode and a first cathode of arc plasma respectively, after the arc furnace is evacuated and then is filled with a first working atmosphere, performing a first arc discharge so that impurities in the gadolinium ingot are removed in a form of volatilization to obtain purified gadolinium with a purity not less than 99.9%;

(2). preparation of GONPs: the purified gadolinium and the tungsten rod are used as a second anode and a second cathode, respectively, after the arc furnace is evacuated and then is filled with a second working atmosphere, performing a second arc discharge and obtaining GONPs from an inner wall of the arc furnace.

2. The method according to claim 1, the first cathode and the first anode are arranged opposite to each other and placed in a vertical or horizontal direction in the arc furnace.

3. The method according to claim 1, the mass of the gadolinium ingot is in a range of 15 g-20 g, and the distance between the first anode and the first cathode is in a range of 6 mm-10 mm, a discharge current is in a range of 100 A-200 A and a discharge time is in a range of 20 min-40 min.

4. The method according to claim 1, the first working atmosphere is a mixed gas with a gas pressure of 30 kPa-70 kPa of argon (Ar) and hydrogen ($H_2$) or pure argon (Ar), and a volume ratio of argon (Ar) and hydrogen ($H_2$) is in a range of 95:5-85:15 in the mixed gas.

5. The method according to claim 1, the second cathode and the second anode are arranged opposite to each other and placed in a vertical or a horizontal direction in the arc furnace, a distance between the second anode and the second cathode is in a range of 3 mm-6 mm.

6. The method according to claim 1, the mass of the purified gadolinium ingot is in a range of 15 g-20 g, a discharge current is in a range of 100 A-200 A and a discharge time is in a range of 10 min-120 min.

7. The method according to claim 1, the second working atmosphere is air.

* * * * *